US010977884B2

(12) United States Patent
Golsch et al.

(10) Patent No.: US 10,977,884 B2
(45) Date of Patent: Apr. 13, 2021

(54) HALF-HEMISPHERE ANTENNAS FOR LOCATING REMOTE DEVICES

(71) Applicants: DENSO International America, Inc., Southfield, MI (US); DENSO CORPORATION, Kariya (JP)

(72) Inventors: Kyle Golsch, Pontiac, MI (US); Raymond Michael Stitt, Ada, MI (US); Eric Smith, Holland, MI (US)

(73) Assignees: DENSO International America, Inc., Southfield, MI (US); DENSO CORPORATION, Kariya (JP)

( * ) Notice: Subject to any disclaimer, the term of this patent is extended or adjusted under 35 U.S.C. 154(b) by 0 days.

(21) Appl. No.: 16/456,566

(22) Filed: Jun. 28, 2019

(65) Prior Publication Data

US 2020/0013249 A1 Jan. 9, 2020

Related U.S. Application Data

(60) Provisional application No. 62/826,155, filed on Mar. 29, 2019, provisional application No. 62/695,272, filed on Jul. 9, 2018.

(51) Int. Cl.
*G07C 9/00* (2020.01)
*H01Q 1/32* (2006.01)
(Continued)

(52) U.S. Cl.
CPC ..... *G07C 9/00309* (2013.01); *G07C 9/29* (2020.01); *H01Q 1/3291* (2013.01); *H01Q 21/28* (2013.01); *G07C 2009/00357* (2013.01)

(58) Field of Classification Search
CPC ..... G07C 9/00309; G07C 2009/00769; G07C 9/00571; G07C 9/28; G07C 9/20;
(Continued)

(56) References Cited

U.S. PATENT DOCUMENTS 6,133,891 A * 10/2000 Josypenko ..... H01Q 1/362 343/860
7,313,467 B2 * 12/2007 Breed ..... G07C 5/008 307/9.1
(Continued)

FOREIGN PATENT DOCUMENTS

BR 10201401746 2/2016
CN 10457459 4/2015
(Continued)

OTHER PUBLICATIONS

U.S. Appl. No. 15/842,479, filed Dec. 14, 2017, Smith et al.
U.S. Appl. No. 16/435,662, filed Jun. 10, 2019, Smith et al.

*Primary Examiner* — Adnan Aziz
(74) *Attorney, Agent, or Firm* — Harness, Dickey & Pierce, P.L.C.

(57) ABSTRACT

A method and apparatus includes a processor that receives information corresponding to a first signal strength of a communication link between a remote device and a communication gateway of a vehicle. The information corresponding to the first signal strength is associated with a first antenna of a sensor and the first antenna includes a first peak main lobe magnitude oriented in a first direction. The processor also receives information corresponding to a second signal strength of the communication link. The information corresponding to the second signal strength is associated with a second antenna. The second antenna includes a second peak main lobe magnitude oriented in a second direction. The processor executes a first boundary line determination that includes determining whether the remote device is located on a first side of a boundary line based on the first signal strength and the second signal strength.

14 Claims, 15 Drawing Sheets

(51) Int. Cl.
*H01Q 21/28* (2006.01)
*G07C 9/29* (2020.01)

(58) Field of Classification Search
CPC ..... G07C 2209/63; G07C 2009/00793; G07C 9/00896; G07C 9/27; G07C 9/00174; G07C 9/29; G07C 2009/00357; G07C 2009/63; H01Q 1/3291; H01Q 1/1257; H01Q 1/3241; H01Q 21/28; H01Q 3/24; H01Q 3/2605
USPC ..... 340/5.61
See application file for complete search history.

(56) References Cited

U.S. PATENT DOCUMENTS

| | | | | |
|---|---|---|---|---|
| 8,130,076 | B2 * | 3/2012 | Nakajima | B60R 25/245 340/426.16 |
| 9,688,247 | B1 | 6/2017 | Jayaraman et al. | |
| 9,859,998 | B2 * | 1/2018 | Li | H04B 17/3913 |
| 9,875,587 | B2 * | 1/2018 | Kim | G07C 9/20 |
| 9,894,492 | B1 | 2/2018 | Elangovan et al. | |
| 9,928,673 | B2 * | 3/2018 | Berezin | G01S 5/04 |
| 10,002,479 | B2 | 6/2018 | Oz et al. | |
| 10,083,555 | B2 * | 9/2018 | Woo | G07C 9/00309 |
| 10,112,580 | B2 * | 10/2018 | Ji | B60R 25/24 |
| 10,168,415 | B2 * | 1/2019 | Kanaga | G01S 11/06 |
| 10,285,013 | B2 * | 5/2019 | Ledvina | B60R 25/24 |
| 2006/0224290 | A1 * | 10/2006 | Nakashima | B60R 25/24 701/49 |
| 2011/0215921 | A1 | 9/2011 | Ben Ayed et al. | |
| 2012/0045058 | A1 | 2/2012 | Weghaus | |
| 2014/0274013 | A1 | 9/2014 | Santavicca | |
| 2015/0148989 | A1 | 5/2015 | Cooper et al. | |
| 2015/0161832 | A1 | 6/2015 | Esselink et al. | |
| 2015/0235486 | A1 * | 8/2015 | Ellis | G07C 9/00309 340/5.61 |
| 2015/0310681 | A1 | 10/2015 | Avery et al. | |
| 2015/0356797 | A1 | 12/2015 | McBride et al. | |
| 2016/0150407 | A1 | 5/2016 | Michaud et al. | |
| 2017/0062938 | A1 | 3/2017 | Cheng et al. | |
| 2017/0104589 | A1 | 4/2017 | Lambert et al. | |
| 2017/0132533 | A1 | 5/2017 | Darnell et al. | |
| 2017/0203721 | A1 * | 7/2017 | Hamada | G01S 5/0252 |
| 2017/0303090 | A1 * | 10/2017 | Stitt | H04W 4/029 |
| 2017/0309098 | A1 | 10/2017 | Watters et al. | |
| 2017/0330402 | A1 | 11/2017 | Menard et al. | |
| 2018/0029560 | A1 * | 2/2018 | Mohaupt | B60N 2/002 |
| 2018/0099643 | A1 | 4/2018 | Golsch et al. | |
| 2018/0103414 | A1 | 4/2018 | Golsch | |
| 2018/0126952 | A1 | 5/2018 | Niemiec | |
| 2018/0154865 | A1 | 6/2018 | Bianchi, III et al. | |
| 2018/0213355 | A1 | 7/2018 | Smith et al. | |
| 2018/0269565 | A1 | 9/2018 | Guthrie et al. | |
| 2019/0081406 | A1 * | 3/2019 | Doskocil | H01Q 15/24 |

FOREIGN PATENT DOCUMENTS

| | | | |
|---|---|---|---|
| JP | 2012172334 | A | 9/2012 |
| WO | WO-16156682 | A1 | 10/2016 |
| WO | WO-2017042374 | A1 | 3/2017 |
| WO | WO-2017181050 | A1 | 10/2017 |
| WO | WO-18040641 | A1 | 3/2018 |

* cited by examiner

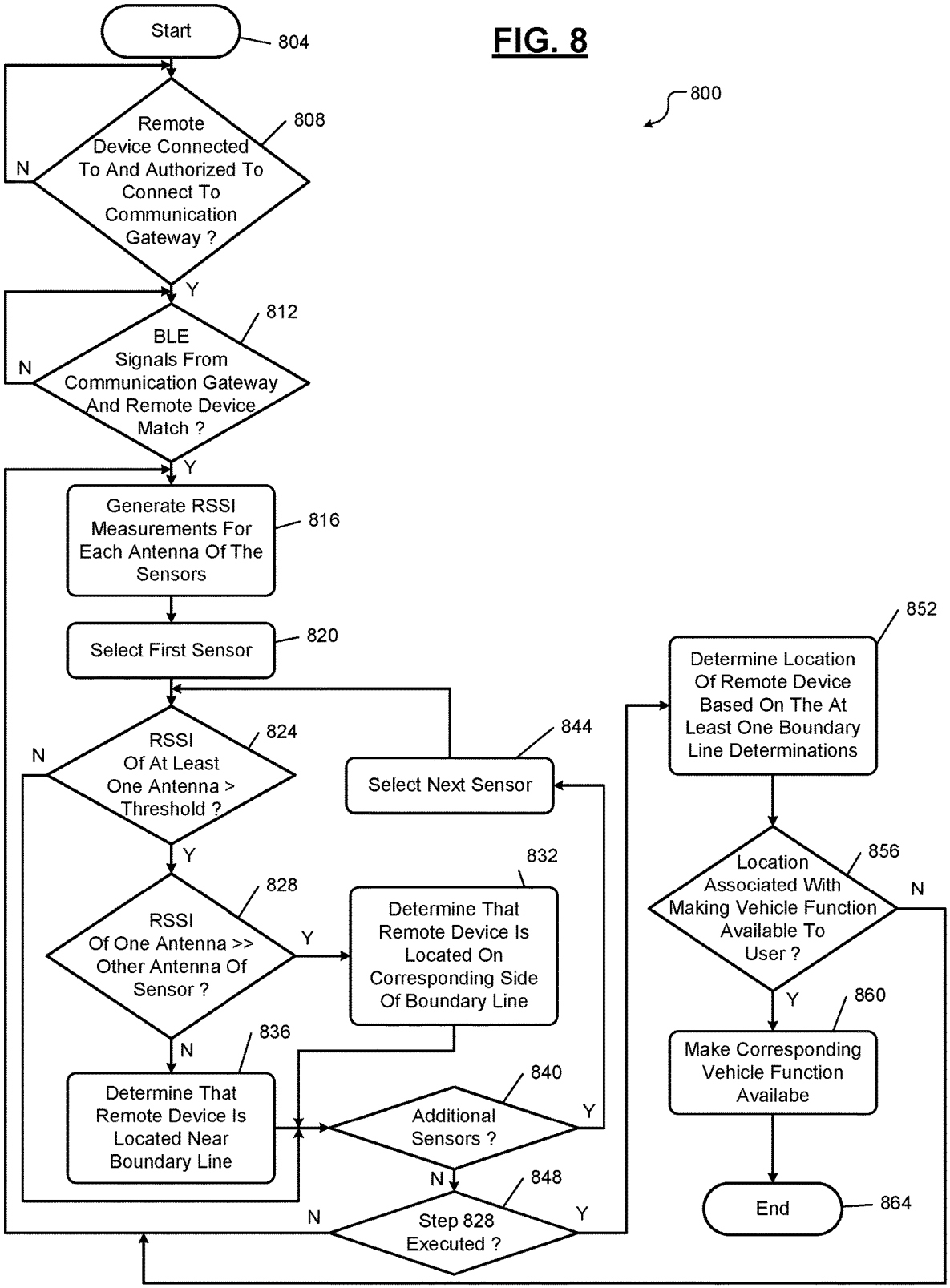
FIG. 8
800
Start
804
Remote Device Connected To And Authorized To Connect To Communication Gateway ?
808
N
Y
BLE Signals From Communication Gateway And Remote Device Match ?
812
N
Y
Generate RSSI Measurements For Each Antenna Of The Sensors
816
Select First Sensor
820
RSSI Of At Least One Antenna > Threshold ?
824
N
Y
RSSI Of One Antenna >> Other Antenna Of Sensor ?
828
Y
N
Determine That Remote Device Is Located On Corresponding Side Of Boundary Line
832
Select Next Sensor
844
Determine That Remote Device Is Located Near Boundary Line
836
Additional Sensors ?
840
Y
N
Step 828 Executed ?
848
N
Y
Determine Location Of Remote Device Based On The At Least One Boundary Line Determinations
852
Location Associated With Making Vehicle Function Available To User ?
856
N
Y
Make Corresponding Vehicle Function Availabe
860
End
864

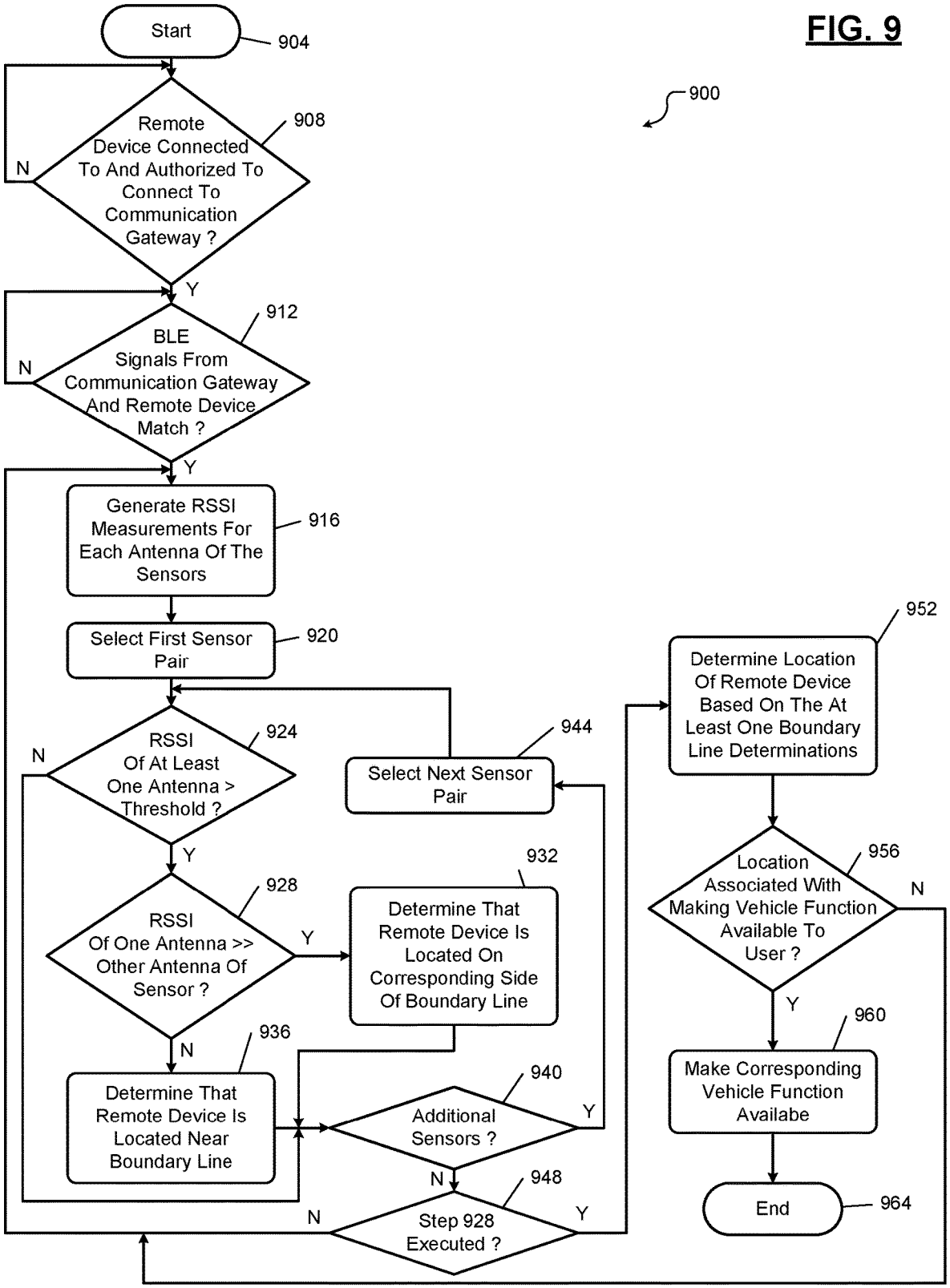
FIG. 9
900
Start
904
Remote Device Connected To And Authorized To Connect To Communication Gateway ?
908
N
Y
BLE Signals From Communication Gateway And Remote Device Match ?
912
N
Y
Generate RSSI Measurements For Each Antenna Of The Sensors
916
Select First Sensor Pair
920
RSSI Of At Least One Antenna > Threshold ?
924
N
Y
RSSI Of One Antenna >> Other Antenna Of Sensor ?
928
Y
N
Determine That Remote Device Is Located On Corresponding Side Of Boundary Line
932
Determine That Remote Device Is Located Near Boundary Line
936
Select Next Sensor Pair
944
Additional Sensors ?
940
Y
N
Step 928 Executed ?
948
N
Y
Determine Location Of Remote Device Based On The At Least One Boundary Line Determinations
952
Location Associated With Making Vehicle Function Available To User ?
956
N
Y
Make Corresponding Vehicle Function Availabe
960
End
964

HALF-HEMISPHERE ANTENNAS FOR LOCATING REMOTE DEVICES

CROSS-REFERENCE TO RELATED APPLICATIONS

This application claims the benefit of U.S. Provisional Application No. 62/695,272 filed on Jul. 9, 2018, and U.S. Provisional Application No. 62/826,155, filed Mar. 29, 2019. The entire disclosure of the above application is incorporated herein by reference.

FIELD

The present disclosure relates to systems and methods for locating remote devices using half-hemisphere antennas.

BACKGROUND

This section provides background information related to the present disclosure and is not necessarily prior art.

Conventional passive entry/passive start (PEPS) systems, which are vehicle systems that include a keyless entry system, may provide a user access to various vehicle functions if the user possesses a key fob that has been previously paired with a vehicle's central PEPS electronic control unit (ECU). As an example, the user in possession of the key fob may unlock and enter the vehicle by grabbing the door handle. As another example, the user in possession of the key fob may activate a vehicle function by pushing a button on the key fob. In response to pushing the button, the central PEPS ECU authenticates the key fob to determine if the key fob is authorized to access the vehicle and uses the signal strength obtained by a plurality of sensors to estimate the distance between the key fob and the vehicle and the location of the key fob relative to the vehicle. If the key fob is authenticated and is located within an authorizing zone, the PEPS system makes the corresponding vehicle function available to the user (i.e., the vehicle is started).

Conventional PEPS systems use proprietary grade radio protocols using low frequency (LF) signals of approximately 125 kHz. LF systems were implemented by conventional PEPS systems because the wave propagation enables relatively accurate estimation of a distance between the key fob and the vehicle and the location of the key fob relative to the vehicle by using signal strengths within a target activation range of, for example, 2 meters. However, due to the extremely long wavelength of the LF signal relative to the size of a vehicle antenna and key fob receiver, it is difficult to reliably communicate with a key fob using LF systems beyond a few meters within reasonable power consumption and safe transmit power levels. As such, it is difficult to make any of the vehicle's functions available to the user when the key fob is located more than a few meters away from the vehicle.

Accordingly, key fobs are presently being implemented by smart devices, such as smartphones and wearable devices, wherein the smart devices are able to communicate at a range greater than the activation range of LF systems. Furthermore, PEPS systems that include key fobs that are implemented by key fobs may accurately estimate the distance between the key fob and the vehicle at greater target activation ranges (e.g., 100 meters). As such, smart devices enable the availability of various vehicle functions and long range distancing features, such as passive welcome lighting, distance bounding on remote parking applications, etc.

While the PEPS systems may be able to estimate the distance between the key fob, which is implemented by the smart device, and the vehicle at greater target activation ranges, the PEPS systems may not be configured to accurately detect the location of the key fob relative to the vehicle.

SUMMARY

This section provides a general summary of the disclosure, and is not a comprehensive disclosure of its full scope or all of its features.

An apparatus is disclosed and includes a processor configured to execute instructions stored in a nontransitory computer readable medium. The instructions include: receiving, using the processor, information corresponding to a first signal strength of a communication link between a remote device and a communication gateway of a vehicle, wherein the information corresponding to the first signal strength is associated with a first antenna of a sensor, and wherein the first antenna includes a first peak main lobe magnitude oriented in a first direction; receiving, using the processor, information corresponding to a second signal strength of the communication link, wherein the information corresponding to the second signal strength is associated with a second antenna, and wherein the second antenna includes a second peak main lobe magnitude oriented in a second direction; and executing, using the processor, a first boundary line determination, wherein executing the first boundary line determination includes determining whether the remote device is located on a first side of a boundary line based on the first signal strength and the second signal strength.

In other features, a midpoint of the boundary line is located at a first point, and wherein the first point is equidistant from the first antenna and the second antenna.

In other features, the boundary line is perpendicular to the first direction and the second direction.

In other features, the first antenna and second antenna are physically coupled using a coupling device.

In other features, the coupling device is a window glass.

In other features, the first antenna and second antenna are separated by an air gap.

In other features, the instructions include: receiving, using the processor, information corresponding to a third signal strength of the communication link, wherein the information corresponding to the third signal strength is associated with a third antenna, and wherein the third antenna includes a third peak main lobe magnitude oriented in a third direction; receiving, using the processor, information corresponding to a fourth signal strength of the communication link, wherein the information corresponding to the fourth signal strength is associated with a fourth antenna, and wherein the fourth antenna includes a fourth peak main lobe magnitude oriented in a fourth direction; and executing, using the processor, a second boundary line determination, wherein executing the second boundary line determination includes determining whether the remote device is located on a first side of a second boundary line based on the third signal strength and the fourth signal strength.

In other features, the instructions include determining, using the processor, a location of the remote device based on the first boundary line determination and the second boundary line determination.

In other features, the instructions include activating a vehicle function in response to the location of the remote device being located within a threshold distance of the vehicle.

In other features, the instructions include determining, using the processor, a location of the remote device based on the first boundary line determination.

A method is also disclosed and includes: receiving, using a processor configured to execute instructions stored in a nontransitory computer readable medium, information corresponding to a first signal strength of a communication link between a remote device and a communication gateway of a vehicle, wherein the information corresponding to the first signal strength is associated with a first antenna of a sensor, and wherein the first antenna includes a first peak main lobe magnitude oriented in a first direction; receiving, using the processor, information corresponding to a second signal strength of the communication link, wherein the information corresponding to the second signal strength is associated with a second antenna, and wherein the second antenna includes a second peak main lobe magnitude oriented in a second direction; and executing, using the processor, a first boundary line determination, wherein executing the first boundary line determination includes determining whether the remote device is located on a first side of a boundary line based on the first signal strength and the second signal strength.

In other features, a midpoint of the boundary line is located at a first point, and wherein the first point is equidistant from the first antenna and the second antenna.

In other features, the boundary line is perpendicular to the first direction and the second direction.

In other features, the first antenna and second antenna are physically coupled using a coupling device.

In other features, the coupling device is a window glass.

In other features, the first antenna and second antenna are separated by an air gap.

In other features, the method includes: receiving, using the processor, information corresponding to a third signal strength of the communication link, wherein the information corresponding to the third signal strength is associated with a third antenna, and wherein the third antenna includes a third peak main lobe magnitude oriented in a third direction; receiving, using the processor, information corresponding to a fourth signal strength of the communication link, wherein the information corresponding to the fourth signal strength is associated with a fourth antenna, and wherein the fourth antenna includes a fourth peak main lobe magnitude oriented in a fourth direction; and executing, using the processor, a second boundary line determination, wherein executing the second boundary line determination includes determining whether the remote device is located on a first side of a second boundary line based on the third signal strength and the fourth signal strength.

In other features, the method includes determining, using the processor, a location of the remote device based on the first boundary line determination and the second boundary line determination.

In other features, the method includes activating a vehicle function in response to the location of the remote device being located within a threshold distance of the vehicle.

In other features, the method includes determining, using the processor, a location of the remote device based on the first boundary line determination.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIGS. 8-9 are example flowcharts illustrating control algorithms according to the present disclosure.

Corresponding reference numerals indicate corresponding parts throughout the several views of the drawings.

DETAILED DESCRIPTION

Example embodiments will now be described more fully with reference to the accompanying drawings.

Figure 1:
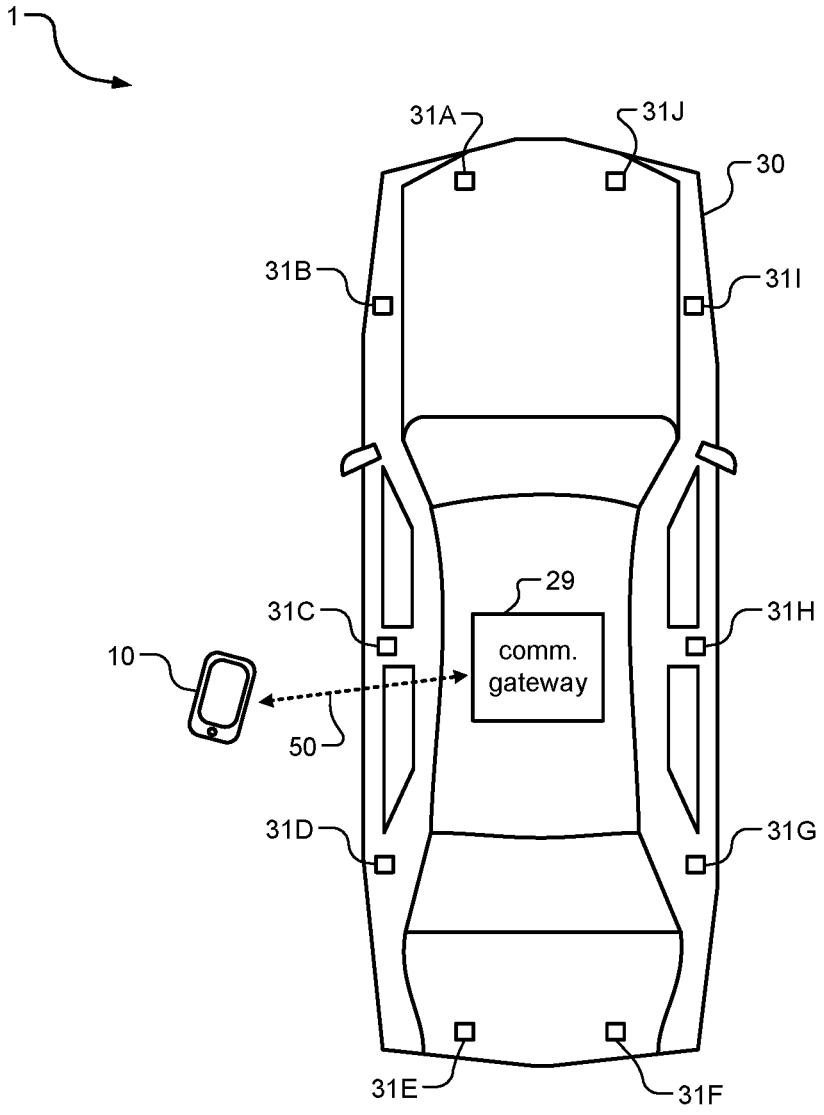
FIG. 1 is an illustration of a vehicle and a remote device according to the present disclosure.
Figure 2:
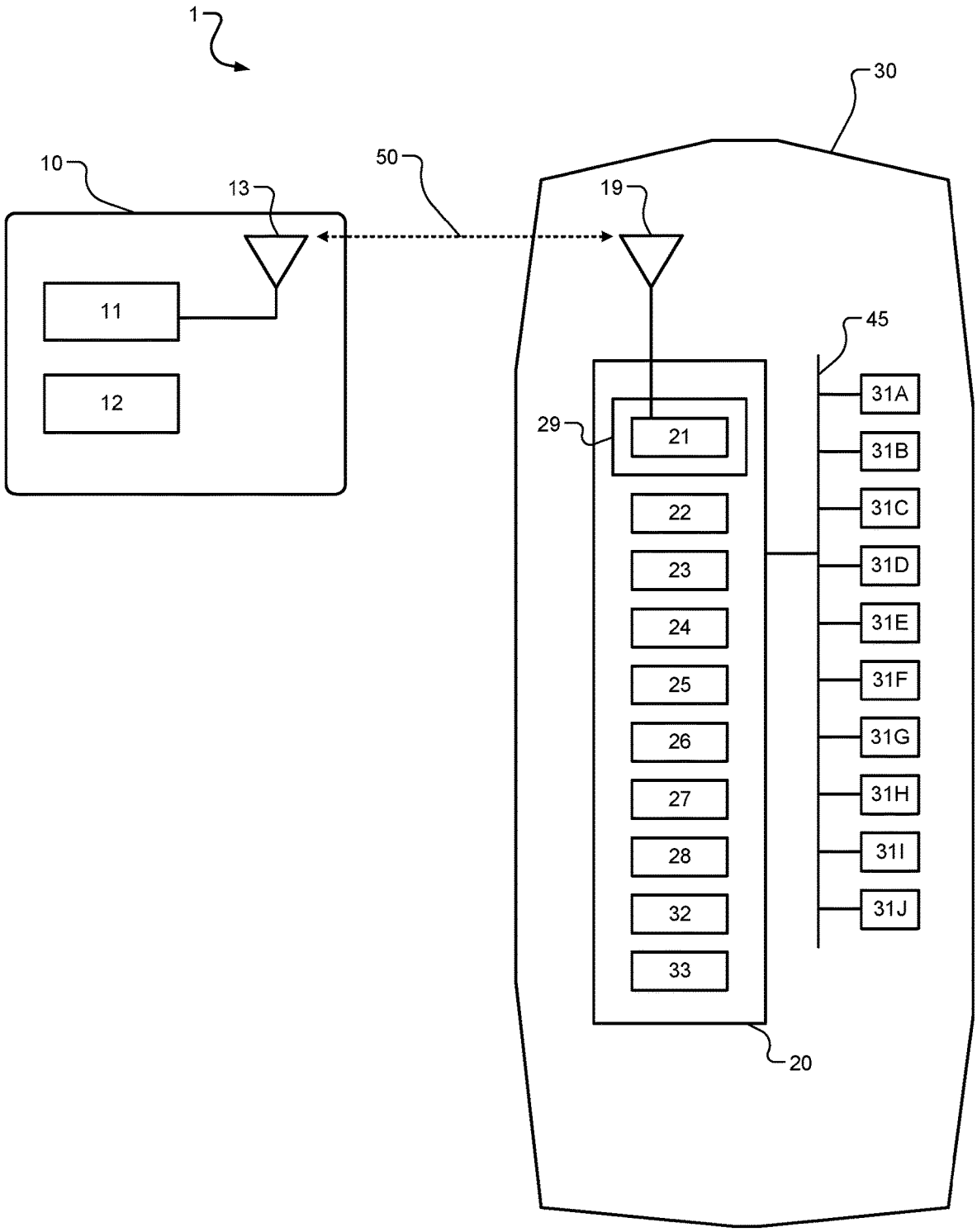
FIG. 2 is a functional block diagram of a vehicle and a remote device according to the present disclosure.

With reference to FIGS. 1-2, a PEPS system 1 is provided within a vehicle 30 and includes a communication gateway 29, a plurality of sensors 31A-31J (collectively referred to as sensors 31), and a control module 20. While FIGS. 1-2 illustrate ten sensors 31A-31J, any number of sensors may be used. Furthermore, while FIG. 2 illustrates one control module 20, the PEPS system 1 may include one or more control modules 20 that are distributed throughout the vehicle 30.

The one or more control modules 20 and the sensors 31 may communicate with each other using a vehicle interface 45. As an example, the vehicle interface 45 may include a controller area network (CAN) bus for communication between main modules. As another example, the vehicle interface 45 may include a local interconnect network (LIN) for lower data-rate communication. In other embodiments, the vehicle interface 45 may include a clock extension peripheral interface (CXPI) bus. Additionally or alternatively, the vehicle interface 45 may include any combination of the CAN bus, LIN, and CXPI bus communication interfaces.

The control module 20 includes the communication gateway 29, which includes a BLE chipset 21 connected to an antenna 19. As shown in FIG. 2, the antenna 19 may be located in the vehicle 30. Alternatively, the antenna 19 may be located outside of the vehicle 30 or within the control module 20. The control module 20 may also include a link authentication module 22 that authenticates the remote device 10 for communication via communication link 50. As an example, the link authentication module 22 may be configured to execute challenge-response authentication or other cryptographic verification algorithms in order to authenticate the remote device 10.

The control module 20 may also include a data management layer 23 for push data. As an example, the data management layer 23 is configured obtain vehicle information obtained by any of the modules (e.g., location information obtained by a telematics module 26) and transmit the vehicle information to the remote device 10.

The control module 20 may also include a connection information distribution module 24 that is configured to obtain information corresponding to the communication channels and channel switching parameters of the communication link 50 and transmit the information to the sensors 31. In response to the sensors 31 receiving the information from the connection information distribution module 24 via the vehicle interface 45 and the sensors 31 being synchronized with the communication gateway 29, the sensors 31 may locate and follow, or eavesdrop on, the communication link 50.

The control module 20 may also include a timing control module 25, which obtains timing information corresponding to the communication link 50 when the link authentication module 22 executes challenge-response authentication. Furthermore, the timing control module 25 is configured to provide the timing information to provide the timing information to the sensors 31 via the vehicle interface 45.

The control module 20 may also include the telematics module 26, which is configured to generate location information and/or error of location information associated with the vehicle 30. The telematics module 26 may be implemented by a global navigation satellite system (e.g., GPS), inertial navigation system, global system for mobile communication (GSM) system, or other location system.

The control module 20 may also include a security filtering module 33 that is configured to detect violations of the physical layer and protocol and filter the data accordingly before providing the information to a sensor processing and localization module 32. The security filtering module 33 may also be configured to flag data as injected so that the sensor processing and localization module 32 may discard the flagged data and alert the PEPS system 1. The data from the sensor processing and localization module 32 is provided to the PEPS module 27, which is configured to read vehicle state information from the sensors 31 in order to detect user intent to access a vehicle function and to compare the location of the remote device 10 to the set of locations that authorize certain functions, such as unlocking a door of the vehicle 30 and/or starting the vehicle 30.

In order to carry out the above functionality of the various modules described above, the control module 20 may also include one or more processors that are configured to execute instructions stored in a nontransitory computer-readable medium, such as a read-only memory (ROM) and/or random access memory (RAM).

As shown in FIGS. 1-2, a remote device 10 may communicate with the communication gateway 29 of the vehicle 30 via the communication link 50. Without limitation, the remote device 10 may be any Bluetooth enabled communication device, such as a smart phone, smart watch, wearable electronic device, key fob, tablet device, or other device associated with a user of the vehicle 30, such as an owner, driver, passenger of the vehicle 30, and/or a technician for the vehicle 30. The communication link 50 may be a Bluetooth communication link as provided for and defined by the Bluetooth specification. As an example, the communication link 50 may be a Bluetooth low energy (BLE) communication link.

The remote device 10 may include a Bluetooth chipset 11 connected to an antenna 13. The remote device 10 may also include application code 12 that is executable by the processor of the remote device 10 and stored in a nontransitory computer-readable medium, such as a read-only memory (ROM) or a random-access memory (RAM). Based on the application code 12 and using the Bluetooth chipset 11 and the antenna 13, the remote device 10 may be configured to execute various instructions corresponding to, for example, authentication of the communication link 50, transmission of location and/or velocity information obtained by a global navigation satellite system (e.g., GPS) sensor or accelerometer of the remote device 10, and manual activation of a vehicle function.

Figure 3:
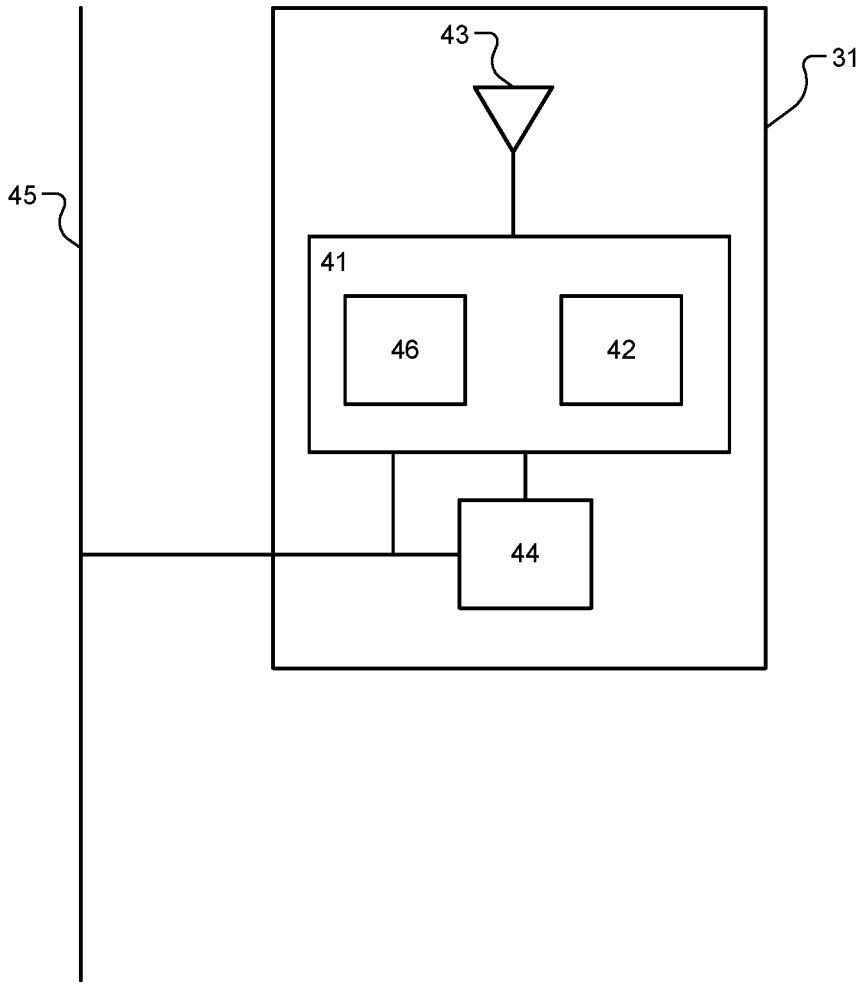
FIG. 3 is a functional block diagram of a sensor of a vehicle according to the present disclosure.

With reference to FIG. 3, each of the sensors 31 includes a BLE chipset 41 connected to an antenna 43. As shown in FIG. 3, the antenna 43 may be located internal to the sensors 31. Alternatively, the antenna 43 may be located external to the sensors 31. The antenna 43 is described below in further detail with reference to FIG. 5.

The sensors 31 receive BLE signals using the antenna 43 and, specifically, receive BLE physical layer messages using a BLE physical layer (PHY) controller 46. The sensors 31 are configured to observe BLE physical layer messages and obtain measurements of the physical properties of the associated signals, including, for example, the received signal strength indication (RSSI) using a channel map that is produced by a channel map reconstruction module 42. Additionally or alternatively, the sensors 31 may communicate with each other and/or communicate with the communication gateway 29 via the vehicle interface 45 to determine time difference of arrival, time of arrival, or angle of arrival data for signals received by multiple sensors 31.

A timing synchronization module 44 is configured to accurately measure the reception times of messages on the vehicle interface 45 and pass the timing information to the BLE chipset 41. The BLE chipset 41 is configured to tune the PHY controller 46 to a specific channel at a specific time based on the channel map information and the timing signals. Furthermore, the BLE chipset 41 is configured to observe all physical layer messages and data that conform to the Bluetooth physical layer specification, which includes the normal data rates proposed or adopted in, for example, the Bluetooth Specification version 5.0. The data, timestamps, and measured signal strength may be reported by the BLE chipset 41 to the various modules of the control module 20 via the vehicle interface 45.

Figure 4:
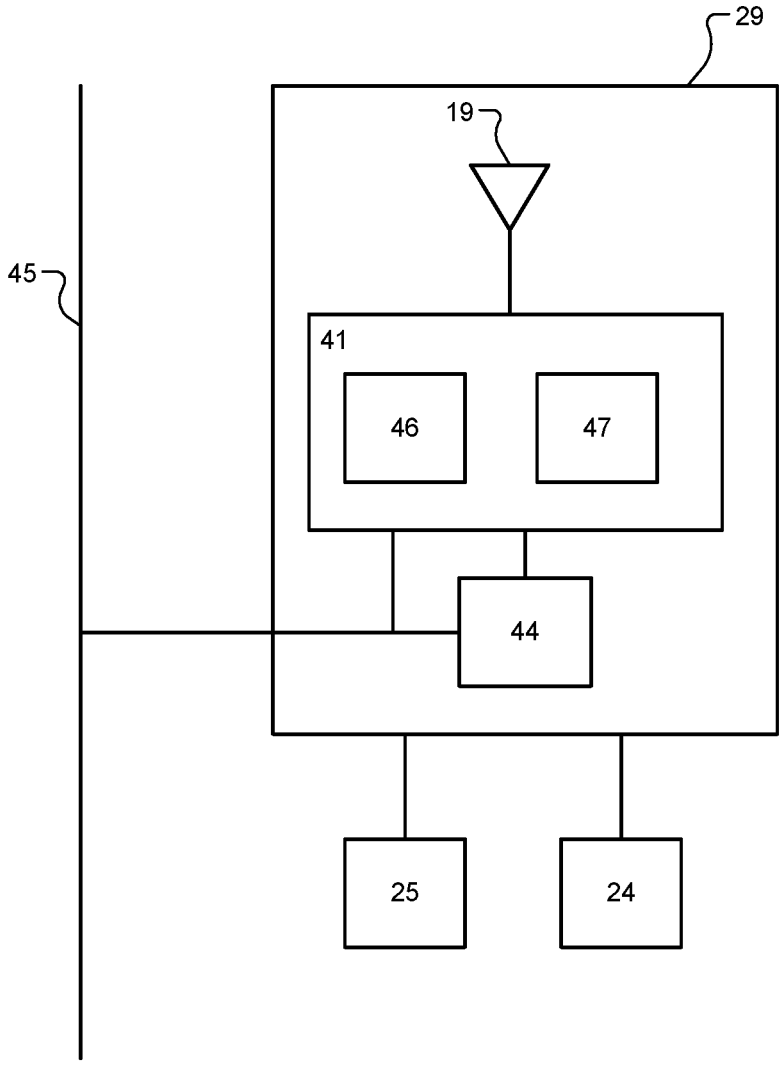
FIG. 4 is a functional block diagram of a communication gateway of a vehicle according to the present disclosure.

With reference to FIG. 4, the communication gateway 29 includes the BLE chipset 41 connected to an antenna 19 to receive BLE signals. The BLE chipset 41 implements a Bluetooth protocol stack 46 that is, for example, compliant with the BLE specification (i.e., Bluetooth Specification version 5.0). The BLE chipset 41 may also include an application 47 implemented by application code that is executable by a processor of the BLE chipset 41. Additionally or alternatively, the application 47 may be executable by a processor of the control module 20 and may be stored in a nontransitory computer-readable medium of the control module 20.

The application 47 may include code corresponding to modifications outside of the Bluetooth specification to enable the BLE chipset 41 to inspect timestamped data transmitted and received by the BLE chipset 41, regardless of the validity of the data. For example, the application 47 enables the BLE chipset 41 to compare transmitted and received data against expectations. The communication gateway 29 is configured to transmit the actual transmitted and received data to the various modules of the control module 20 via the vehicle interface 45. Alternatively, the communication gateway 29 may be configured to receive the data from each of the sensors 31 via the vehicle interface 45. The application 47 may be further configured to enable the BLE chipset 41 to confirm that each of the sensors 31 has received the correct data at the correct time.

The Bluetooth protocol stack 46 is configured to provide the channel map, access identifier, next channel, and the time to the next channel to the application 47. The Bluetooth protocol stack 46 is configured to output timing signals for the timestamps of transmission and reception events to the application 47 and/or a digital PIN output of the BLE chipset 41. The communication gateway 29 also includes a timing synchronization module 44, which is configured to accept the timing signals and works in conjunction with the vehicle interface 45 to create accurate time stamps of connection information messages and other communications.

With continued reference to FIG. 4, the communication gateway 29 may provide timing information and channel map information to the timing control module 25 and, respectively. The communication gateway 29 may be configured to provide information corresponding to ongoing connections to the connection information distribution module 24 and timing signals to the timing control modules 25 so that the sensors 31 can find and follow, or eavesdrop on, the communication link 50.

Figure 5:
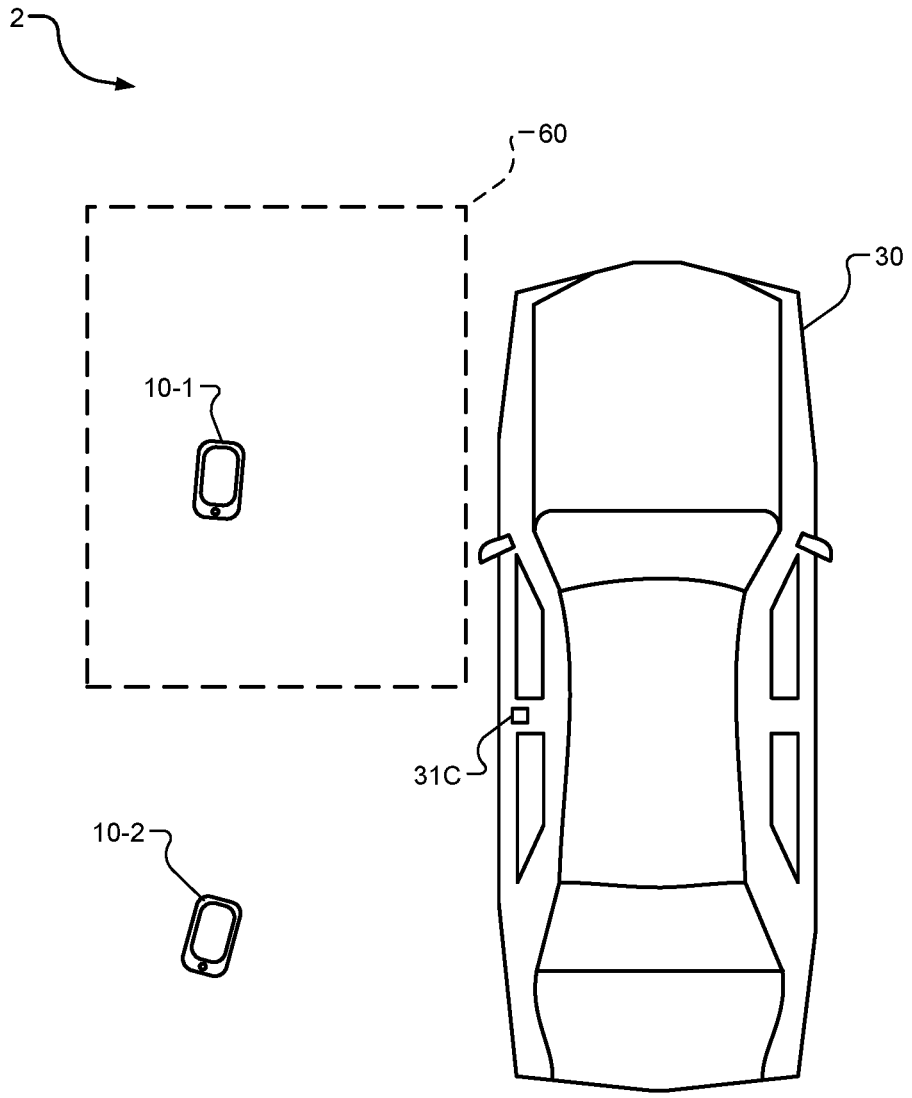
FIG. 5 is a functional block diagram of a vehicle and a plurality of remote devices according to the present disclosure.

With reference to FIG. 5, PEPS system 2 is shown and includes the vehicle 30 and remote devices 10-1, 10-2. The PEPS system 2 is similar to the PEPS system 1 described above with reference to FIGS. 1-4, but in this embodiment, both of the remote devices 10-1, 10-2 are paired to the communication gateway 29 (not shown) of the vehicle 30. Furthermore, the antenna 43 (not shown) of sensor 31C is implemented by an omnidirectional antenna, which is defined as an antenna that has approximately non-directional radiation and/or receive characteristics in a first plane and directional radiation and/or receive characteristics in any orthogonal plane with respect to the first plane. As an example, when ignoring the impacts of reflections, the omnidirectional antenna may have a circular gain pattern in a first plane (e.g., a horizontal plane of the sensor 31C) and a noncircular gain pattern in a second, orthogonal plane (e.g., in the second plane, the gain of the omnidirectional antenna from 90° to −90° passing through 0° is uniform and approximately −30 dBM, and the gain of the omnidirectional antenna from 90° to −90° passing through 180° is between −40 dBM and −50 dBM, thereby forming a front lobe and a back lobe and/or side lobes). The omnidirectional antenna may be implemented by, for example, a dipole or a collinear antenna.

Based on RSSI measurements obtained using the sensor 31C, the control module 20 (not shown) is configured to determine a distance between the remote devices 10-1, 10-2 and the vehicle 30. As shown in FIG. 5, the remote devices 10-1, 10-2 are located approximately equidistant from a driver-side door of the vehicle 30. However, due to the circular gain pattern of the antenna 43, the control module 20 may not accurately determine the location of the remote devices 10-1, 10-2 with respect to the vehicle 30. In other words, the control module 20 may incorrectly determine that the remote device 10-1 is not located in a vehicle function activation zone 60. Furthermore, the control module 20 may incorrectly determine that the remote device 10-2 is located in the vehicle function activation zone 60 when it is actually located outside of the vehicle function activation zone 60. Accordingly, the PEPS system 2 may incorrectly make the corresponding vehicle function associated with the vehicle function activation zone 60 available to the user or incorrectly fail to make the corresponding vehicle function available using an omnidirectional antenna.

Figure 6A:
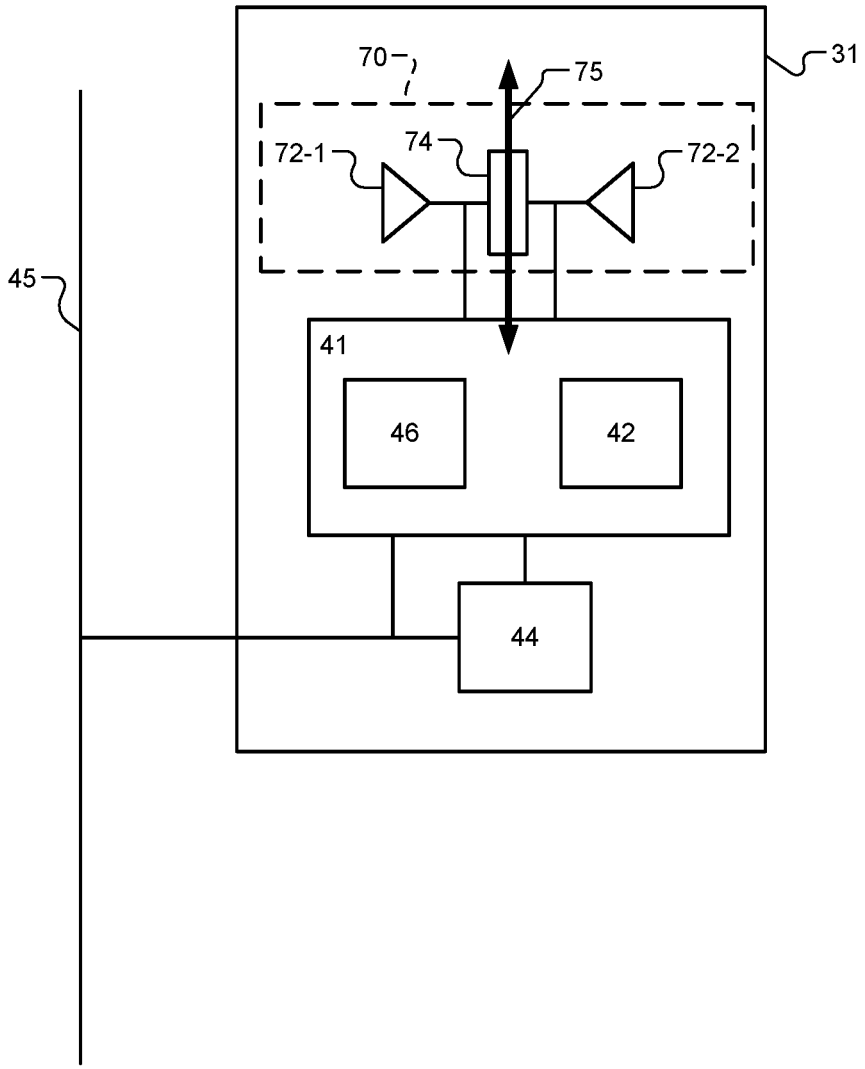
FIG. 6A is a functional block diagram of an example antenna system of a sensor according to the present disclosure.
Figure 6B:
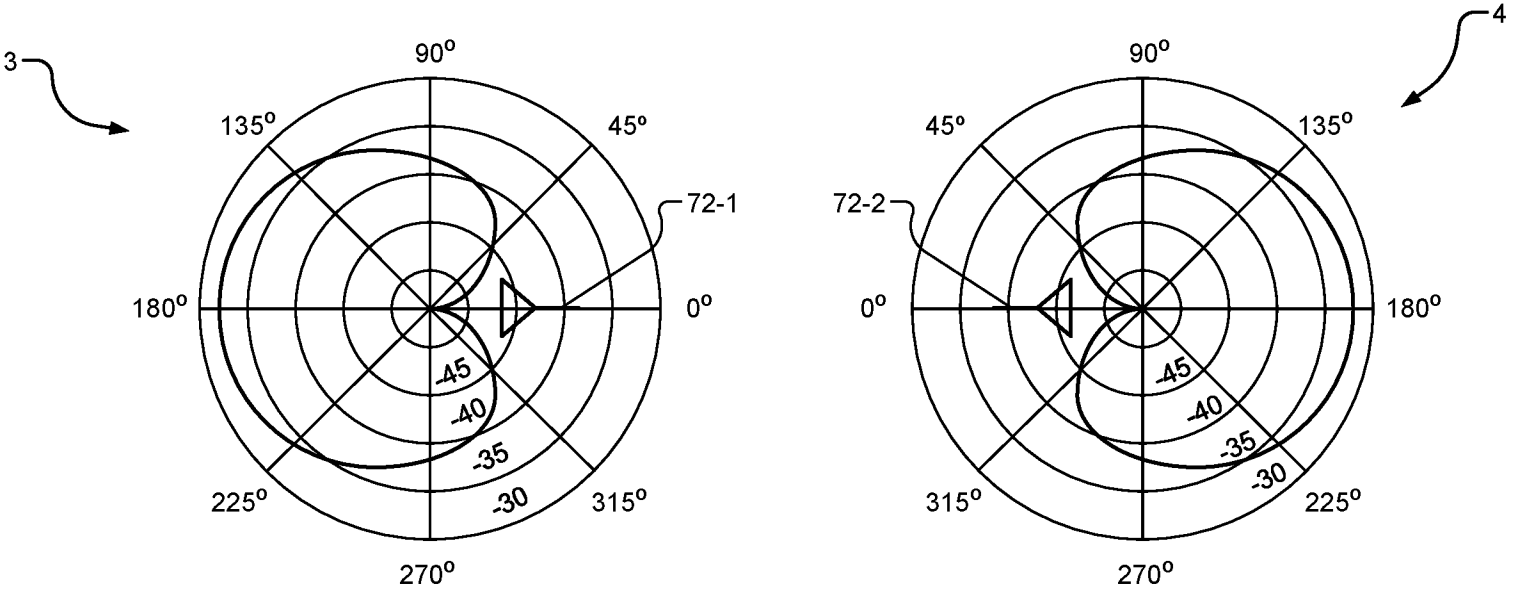
FIG. 6B is an illustration of a polar plot of a gain of the antennas of the antenna system according to the present disclosure.

With reference to FIGS. 6A-6B, an example antenna system 70 of the sensor 31 is shown. The antenna system 70 includes a pair of half-hemisphere antennas 72-1, 72-2 (collectively referred to as half-hemisphere antennas 72). As described herein, the half-hemisphere antennas 72 are defined as directional antennas that have a large gain pattern in a first direction and a lower gain pattern in each of the remaining directions. Furthermore, the large gain pattern and the lower gain patterns may each be approximately uniform. Additionally, the large gain pattern may be associated with a front lobe and one of the lower gain patterns may be associated with a back lobe, wherein the front lobe and the back lobe are approximately symmetric and have a front-to-back gain ratio that is greater than 1. The half-hemisphere antennas 72 may be oriented such that the respective front lobes are diametrically opposed to each other.

Example polar plots 3, 4 indicating the large and one of the lower gain patterns of diametrically opposed half-hemisphere antennas 72 are shown in FIG. 6B. In this embodiment, half-hemisphere antennas 72 each have a front lobe with a large and approximately uniform gain value from 90° to −90° passing through 0°, and a back lobe with a smaller and approximately uniform gain value from 90° to −90° passing through 180°.

In some embodiments, the half-hemisphere antennas 72 may be physically coupled to each other via coupling device 74. In one embodiment, the coupling device 74 is a poor radio frequency (RF) attenuator. Accordingly, the operation and transmit/receive characteristics of the half-hemisphere antennas 72 are independent of each other. Moreover, the difference of the RSSI measurements of each of the half-hemisphere antennas 72 is not affected by any signal attenuation of the coupling device 74. As an example, the coupling device 74 may be implemented by a window glass material or other similar structure that is a poor RF attenuator. In other embodiments, the coupling device 74 may be removed and the half-hemisphere antennas 72 may be separated via an air gap. The air gap may be configured to prevent coupling effects of the half-hemisphere antennas 72 from affecting the transmit/receive characteristics of the sensors 31. Furthermore, the air gap provides a reflection free environment and, as such, reflections, multipath fading diffraction, refraction, and other sources of amplitude shifting noise sources are either negligible or non-existent.

Figure 6C:
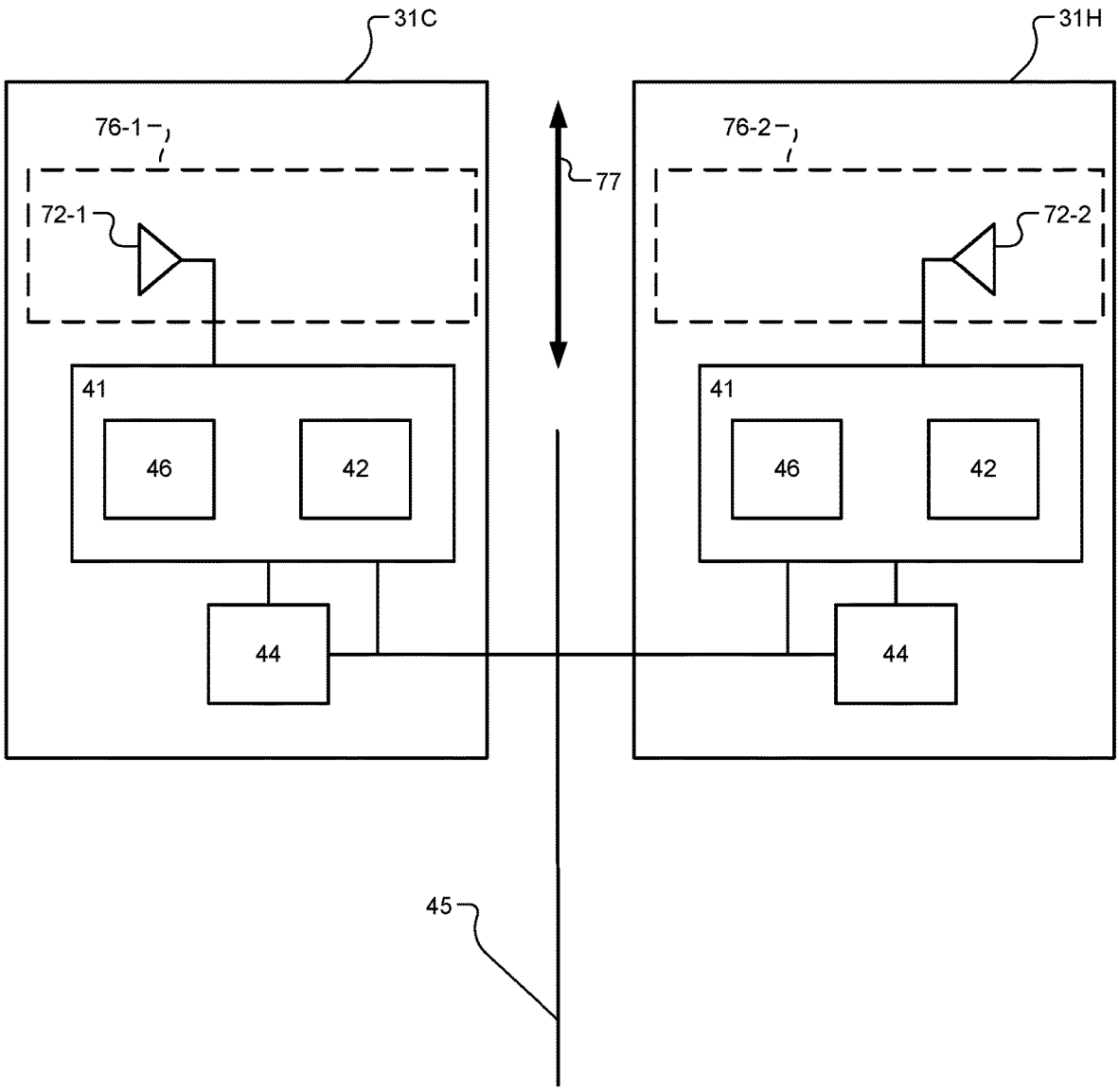
FIG. 6C is a functional block diagram of an example antenna system of a sensor according to the present disclosure

With reference to FIG. 6C, alternative antenna systems 76-1, 76-2 of sensors 31C, 31H are shown. This embodiment is similar to the embodiment described above with reference to FIG. 6A, but in this embodiment, each of the antenna systems 76-1, 76-2 includes one of the half-hemisphere antennas 72-1, 72-2, respectively. Furthermore, the half-hemisphere antennas 72-1, 72-2 are oriented such that the respective front lobes are diametrically opposed to each other.

By incorporating antenna system 70 or antenna system 76 into the sensors 31, the control module 20 is configured to determine a distance between the remote device 10 and the vehicle 30 based on, for example, RSSI measurements obtained by the sensors 31. Additionally, the control module 20 is configured to obtain a location of the remote device 10 with respect to the vehicle 30 based on the RSSI measurements obtained by each half-hemisphere antenna 72 of the sensors 31 (e.g., the control module 20 may determine whether the remote device 10 is located within a vehicle function activation zone). As an example and as described below in further detail, the control module 20 may be able to determine the location of the remote device 10 relative to a boundary line that is located between the half-hemisphere antennas 72. In some embodiments, the boundary line is located equidistant to each of the half-hemisphere antennas 72, as illustrated by line 77 in FIG. 6C. Additionally or alternatively, the boundary line may intersect a midpoint of a surface of the coupling device 74, as illustrated by line 75 in FIG. 6A.

Figure 7A:
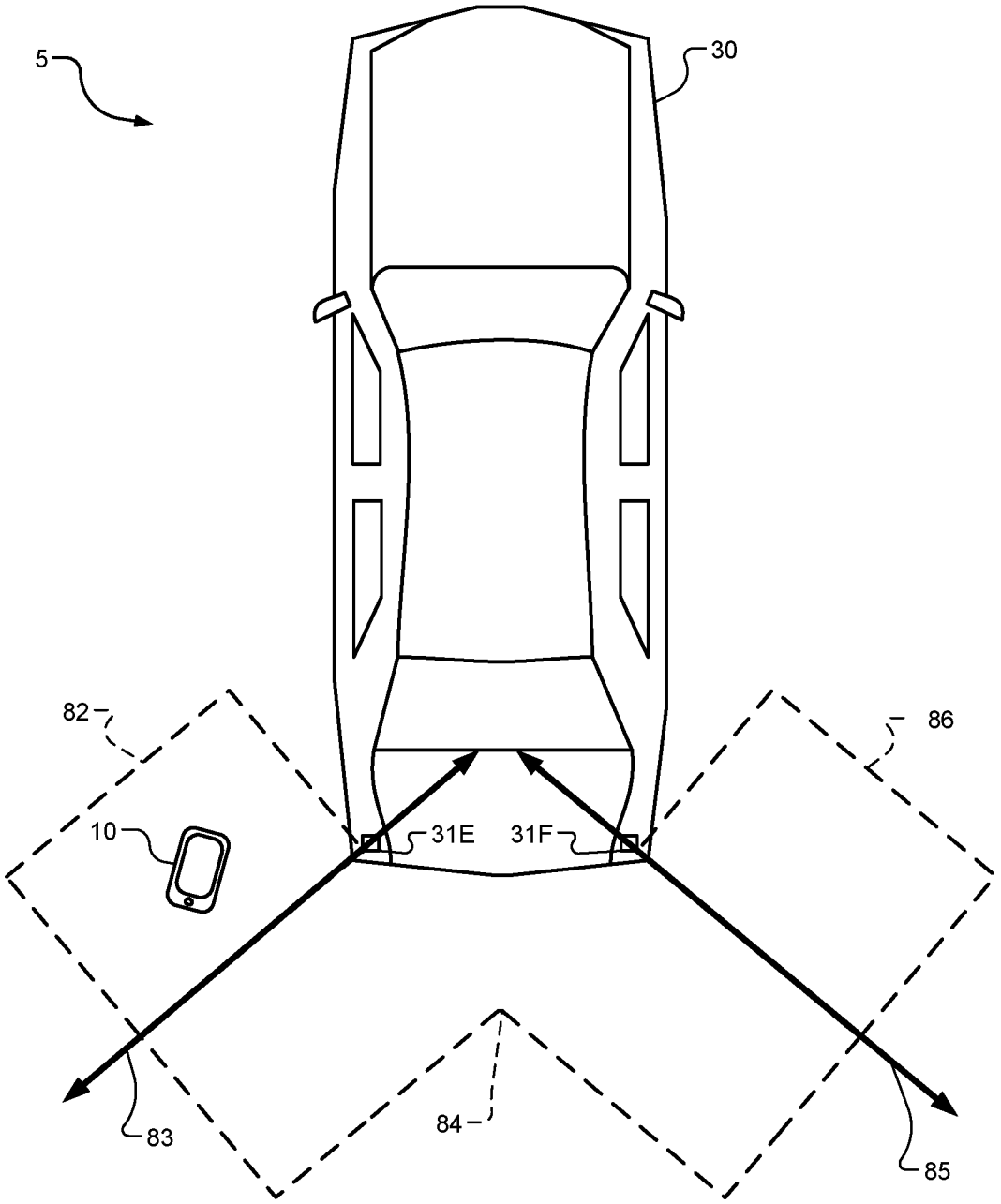
FIGS. 7A-7E are functional block diagrams of a vehicle that includes an antenna system according to the present disclosure.

With reference to FIG. 7A, PEPS system 5 is shown and includes sensors 31E, 31F, which each include antenna system 70 described above with reference to FIG. 6A. As described above, each of the half-hemisphere antennas 72 of the sensors 31E, 31F are configured to obtain an RSSI measurement of the communication link 50 between the remote device 10 and the communication gateway 29 (not shown). Based on at least one of the RSSI measurements obtained by the four half-hemisphere antennas 72 of the corresponding sensors 31E, 31F, the control module 20 is configured to determine a distance between the remote device 10 and the vehicle 30.

Additionally, the control module 20 is configured to determine the location of the remote device 10 based on the RSSI measurements obtained by each of the sensors 31E, 31F. Referring to sensor 31E, if a first half-hemisphere antenna 72-1 with a front lobe oriented above boundary line 83 and towards zone 82 obtains an RSSI measurement that is greater than the second half-hemisphere antenna 72-2, which is diametrically opposed to the first half-hemisphere antenna 72-1, then the control module 20 is configured to determine that the remote device 10 is located above the boundary line 83. Similarly, if the second half-hemisphere antenna 72-2 obtains an RSSI measurement that is greater than the first half-hemisphere antenna 72-1, then the control module 20 is configured to determine that the remote device 10 is located below the boundary line 83 and in zone 84.

Referring to sensor 31F, if a first half-hemisphere antenna 72-1 with a front lobe oriented above boundary line 85 and towards zone 86 obtains an RSSI measurement that is greater than the second half-hemisphere antenna 72-2, which is diametrically opposed to the first half-hemisphere antenna 72-1, then the control module 20 is configured to determine that the remote device 10 is located above the boundary line 85. Similarly, if the second half-hemisphere antenna 72-2 obtains an RSSI measurement that is greater than the first half-hemisphere antenna 72-1, then the control module 20 is configured to determine that the remote device 10 is located below the boundary line 85 and in zone 84.

While this embodiment describes the control module 20 being configured to determine that the remote device 10 is located in zone 84 if the control module 20 determines the remote device 10 is located below boundary line 83 or boundary line 85, in other embodiments, the control module 20 may be configured to determine the remote device 10 is located in zone 84 if the control module 20 determines that the remote device 10 is located below boundary line 83 and boundary line 85.

As shown in FIG. 7A, the control module 20 determines, based on the RSSI measurements obtained by each of the half-hemisphere antennas 72, that the remote device 10 is located in zone 82. Furthermore, if zone 82 is associated with activating a vehicle function (e.g., unlocking a door), the control module 20 may subsequently activate the corresponding vehicle function.

Figure 7B:
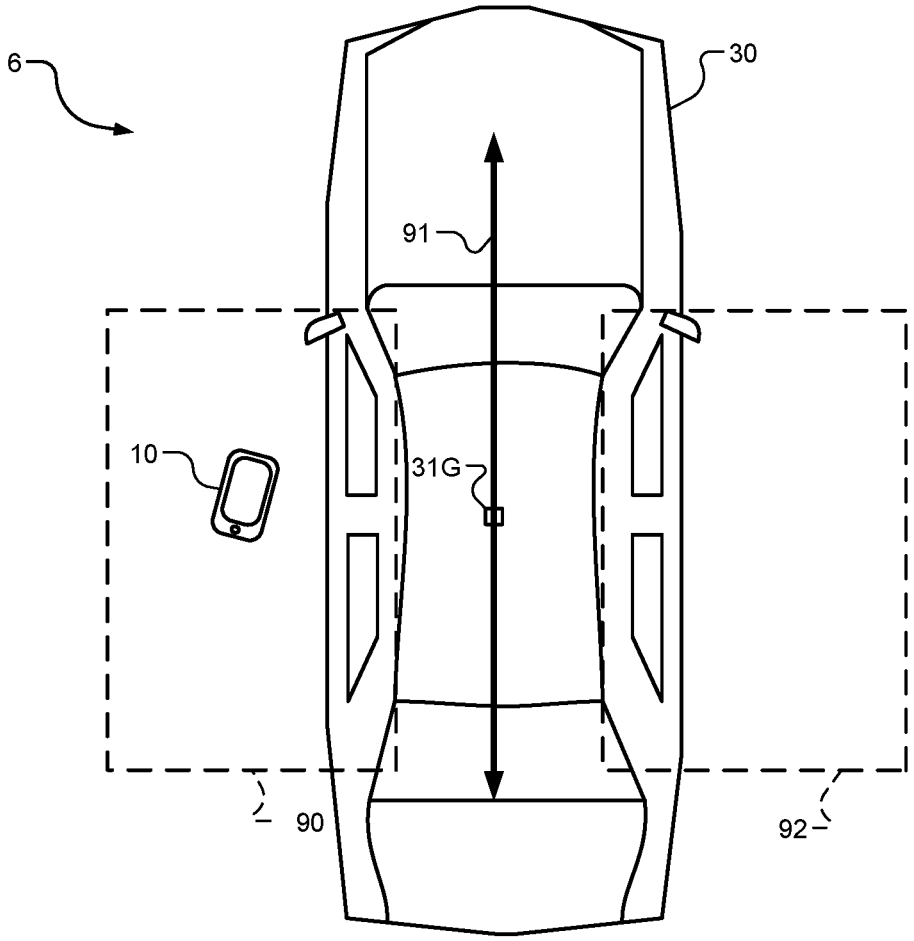

With reference to FIG. 7B, PEPS system 6 is shown and includes sensor 31G, which includes antenna system 70 described above with reference to FIG. 6A. PEPS system 6 is similar to PEPS system 5 described above with reference to FIG. 7A, but in this embodiment, a single sensor 31G is used to determine which side of boundary line 91 the remote device 10 is located. If a first half-hemisphere antenna 72-1 with a front lobe oriented to the left of boundary line 91 and towards zone 90 obtains an RSSI measurement that is greater than the second half-hemisphere antenna 72-2, which is diametrically opposed to the first half-hemisphere antenna 72-1, then the control module 20 is configured to determine that the remote device 10 is located to the left of boundary line 91. Similarly, if the second half-hemisphere antenna 72-2 obtains an RSSI measurement that is greater than the first half-hemisphere antenna 72-1, then the control module 20 is configured to determine that the remote device 10 is located to the right of boundary line 91 and in zone 92.

As shown in FIG. 7B, the control module 20 determines, based on the RSSI measurements obtained by each of the half-hemisphere antennas 72, that the remote device 10 is located in zone 90. Furthermore, if zone 90 is associated with activating a vehicle function (e.g., unlocking a door), the control module 20 may subsequently activate the corresponding vehicle function.

Figure 7C:
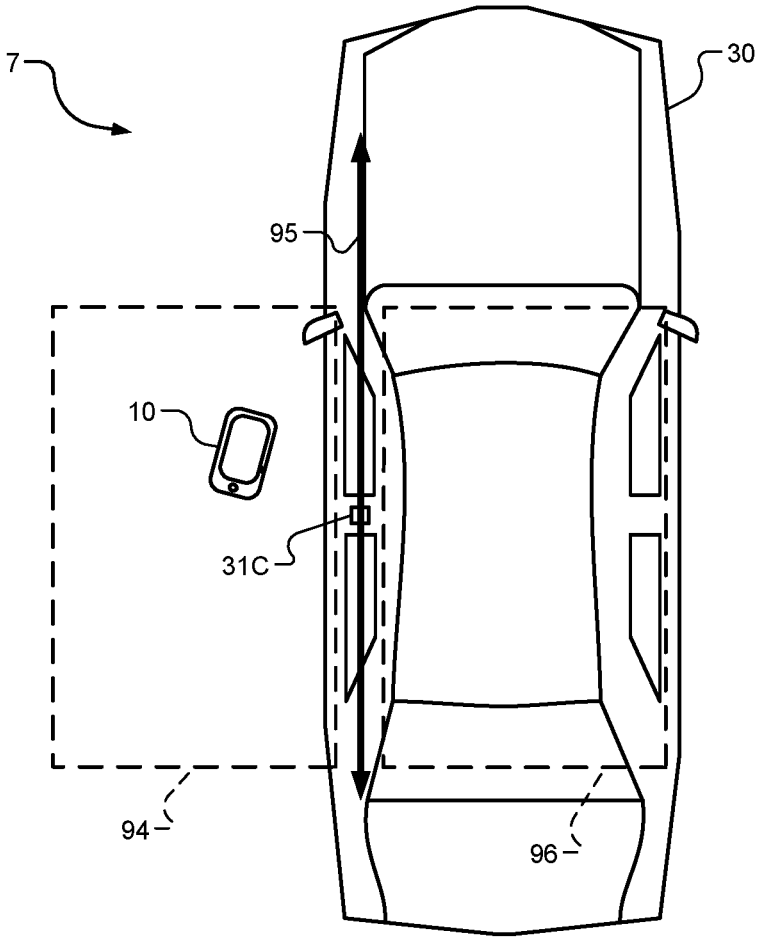

With reference to FIG. 7C, PEPS system 7 is shown. PEPS system 7 is similar to PEPS system 6 described above with reference to FIG. 7B, but in this embodiment, boundary line 95 is located along a door of the vehicle 30. Accordingly, the control module 20 is configured to determine whether the remote device 10 is located inside the vehicle (i.e., zone 96) or located outside the vehicle (i.e., zone 94).

Figure 7D:
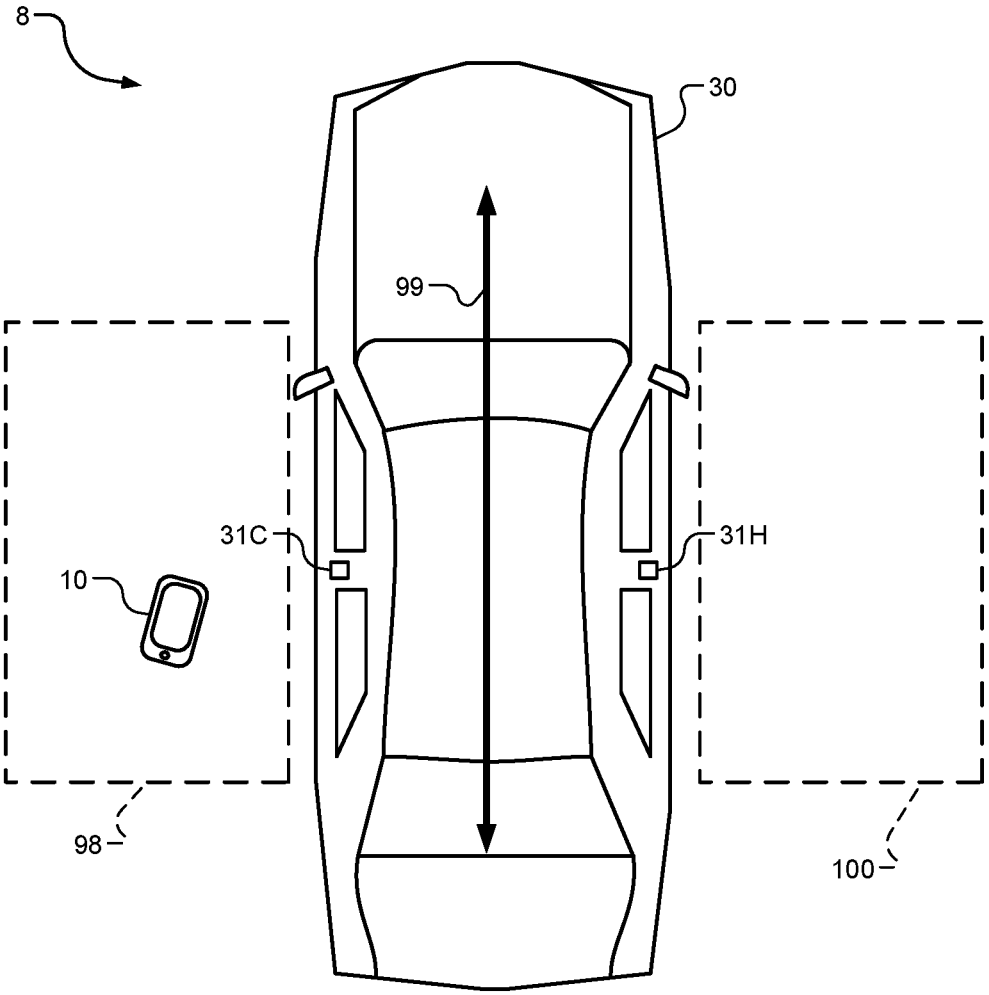

With reference to FIG. 7D, PEPS system 8 is shown and includes sensors 31C, 31H, which each include antenna system 76 described above with reference to FIG. 6C. Specifically, sensor 31C includes a first half-hemisphere antenna 72-1 with a front lobe oriented towards zone 98, and sensor 31H includes a second half-hemisphere antenna 72-1 with a front lobe oriented towards zone 100. If the first half-hemisphere antenna 72-1 obtains an RSSI measurement that is greater than the second half-hemisphere antenna 72-2, which is diametrically opposed to the first half-hemisphere antenna 72-1, then the control module 20 is configured to determine that the remote device 10 is located to the left of boundary line 99 and in zone 98. Similarly, if the second half-hemisphere antenna 72-2 obtains an RSSI measurement that is greater than the first half-hemisphere antenna 72-1, then the control module 20 is configured to determine that the remote device 10 is located to the right of boundary line 99 and in zone 100.

Figure 7E:
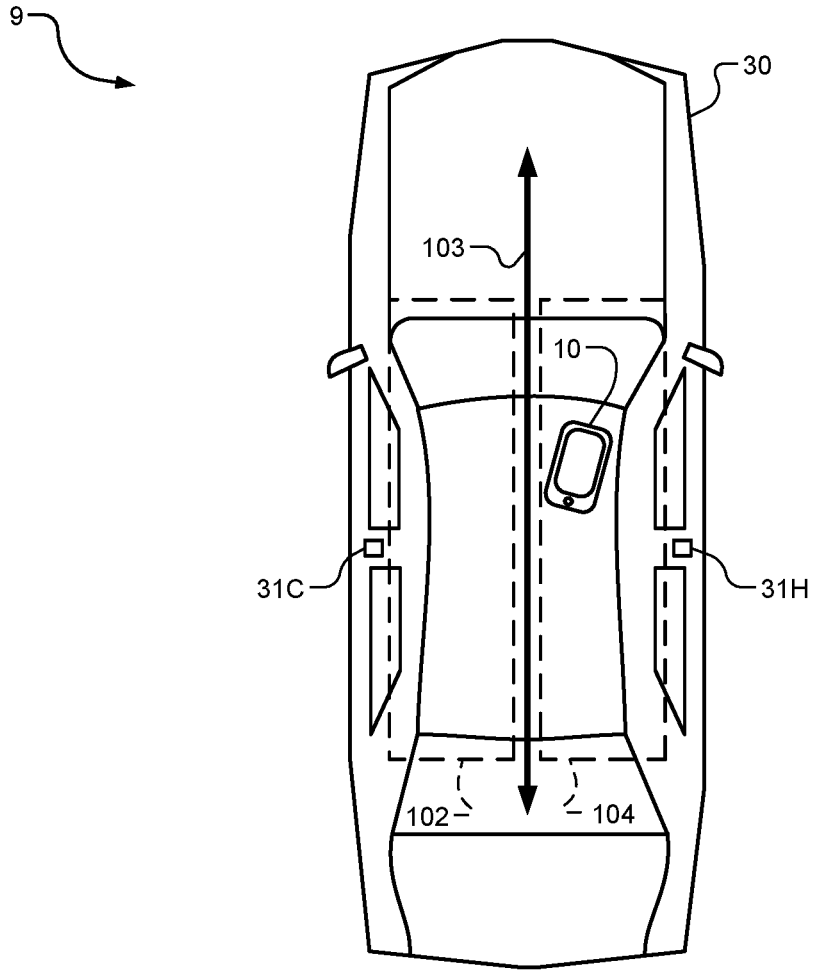

With reference to FIG. 7E, PEPS system 9 is shown. PEPS system 9 is similar to PEPS system 8 described above with reference to FIG. 7D, but in this embodiment, the first half-hemisphere antenna 72-1 of sensor 31C and the second half-hemisphere antenna 72-2 of sensor 31H are not diametrically opposed. Rather, the front lobes of each of the half-hemisphere antennas 72 are oriented towards boundary line 103. If the first half-hemisphere antenna 72-1 obtains an RSSI measurement that is greater than the second half-hemisphere antenna 72-2, then the control module 20 is configured to determine that the remote device 10 is located to the left of boundary line 103 and in zone 102. Similarly, if the second half-hemisphere antenna 72-2 obtains an RSSI measurement that is greater than the first half-hemisphere antenna 72-1, then the control module 20 is configured to determine that the remote device 10 is located to the right of boundary line 103 and in zone 104.

With reference to FIG. 8, a flowchart illustrating a control algorithm 800 for determining the location of the remote device 10 is shown. The control algorithm 800 may be implemented for sensors 31 that include antenna system 70 described above with reference to FIG. 6A. The control algorithm 800 starts at 804 when, for example, the remote device 10 is turned on. At 808, the control algorithm 800 determines, using the control module 20 and/or the remote device 10, whether the remote device 10 is connected to and authorized to connect to the communication gateway 29. As an example, the remote device 10 may be authorized to connect to the communication gateway 29 in response to the link authentication module 22 successfully executing the challenge-response authentication. If the remote device 10 is connected and authorized to connect to the communication gateway 29, the control algorithm 800 proceeds to 808; otherwise, the control algorithm 800 remains at 808 until the remote device 10 is authorized to connect to and connected to the communication gateway 29. At 812, the control algorithm 800 determines, using the control module 20 and/or remote device 10, whether the BLE signals from the communication gateway 29 and the remote device 10 match using, for example, a cryptographic verification algorithm. If so, the control algorithm 800 proceeds to 816; otherwise, the control algorithm 800 remains at 812 until it is determined that the BLE signals match.

At 816, the control algorithm 800 generates, using the sensors 31, RSSI measurements for each half-hemisphere antenna 72 of the sensors 31. At 820, the control algorithm 800 selects, using the control module 20, a first sensor. At 824, the control algorithm 800 determines, using the control module 20, whether the RSSI of at least one of the half-hemisphere antennas 72 is greater than a threshold value. As an example, the threshold value may correspond to a distance value that initiates the boundary line determination steps described below in steps 828-852. In other words, the control module 20 essentially disregards sensors 31 that may negatively impact the accuracy of the boundary line determination algorithm. As an example, if sensor 31E, which is located on a trunk of the vehicle 30, obtains low RSSI measurements as a result of the remote device 10 being located near a front and opposite side of the vehicle 30, the control module 20 will disregard sensor 31E when executing the boundary line determination algorithm. If the RSSI of at least one of the half-hemisphere antennas 72 is greater than the threshold value, the control algorithm 800 proceeds to 828; otherwise, the control algorithm 800 proceeds to 840.

At 828, the control algorithm 800 determines, using the control module 20, whether the RSSI of a first half-hemisphere antenna 72-1 is significantly greater than the RSSI of the second half-hemisphere antenna 72-2. As an example, the RSSI of the first half-hemisphere antenna 72-1 may be significantly greater than the RSSI of the second half-hemisphere antenna 72-2 if it is greater by a predetermined threshold difference. If the RSSI of the first half-hemisphere antenna 72-1 is significantly greater than the RSSI of the second half-hemisphere antenna 72-2, the control algorithm 800 proceeds to 832; otherwise, the control algorithm 800 proceeds to 836. At 832, the control algorithm 800 determines, using the control module 20, that the remote device 10 is located on a corresponding side of the boundary line and proceeds to 840. At 836, the control algorithm 800 determines, using the control module 20, that the remote device 10 is located near the boundary line and proceeds to 840.

At 840, the control algorithm 800 determines, using the control module 20, whether there are additional sensors 31. If so, the control algorithm proceeds to 844; otherwise, the control algorithm 800 proceeds to 848. At 844, the control algorithm 800 selects, using the control module 20, the next sensor 31 and proceeds to 824. At 848, the control algorithm 800 determines, using the control module 20, whether step 828 has previously been executed. If so, the control algorithm 800 proceeds to 852; otherwise, the control algorithm 800 proceeds to 816.

At 852, the control algorithm 800 determines, using the control module 20, a location of the remote device based on the at least one boundary line determination. Additionally, the control module 20 may determine a distance between the remote device 10 and the vehicle 30. At 856, the control algorithm 800 determines whether the location is associated with making a vehicle function available to the user. If so, the control algorithm 800 proceeds to 860; otherwise, the control algorithm 800 proceeds to 816. At 860, the control algorithm 800 makes the corresponding vehicle function available to the user (e.g., unlocking the door) and then ends at 864.

With reference to FIG. 9, a flowchart illustrating a control algorithm 900 for determining the location of the remote device 10 is shown. The control algorithm 900 may be implemented for sensors 31 that include antenna system 76 described above with reference to FIG. 6C. The control algorithm 900 starts at 904 when, for example, the remote device 10 is turned on. At 908, the control algorithm 900 determines, using the control module 20 and/or the remote device 10, whether the remote device 10 is connected to and authorized to connect to the communication gateway 29. As an example, the remote device 10 may be authorized to connect to the communication gateway 29 in response to the link authentication module 22 successfully executing the challenge-response authentication. If the remote device 10 is connected and authorized to connect to the communication gateway 29, the control algorithm 900 proceeds to 908; otherwise, the control algorithm 900 remains at 908 until the remote device 10 is authorized to connect to and connected to the communication gateway 29. At 912, the control algorithm 900 determines, using the control module 20 and/or remote device 10, whether the BLE signals from the communication gateway 29 and the remote device 10 match using, for example, a cryptographic verification algorithm. If so, the control algorithm 900 proceeds to 916; otherwise, the control algorithm 900 remains at 912 until it is determined that the BLE signals match.

At 916, the control algorithm 900 generates, using the sensors 31, RSSI measurements for each half-hemisphere antenna 72 of the sensors 31. At 920, the control algorithm 900 selects, using the control module 20, a first sensor pair (e.g., sensors 31E, 31F). At 924, the control algorithm 900 determines, using the control module 20, whether the RSSI of at least one of the half-hemisphere antennas 72 is greater than a threshold value. As an example, the threshold value may correspond to a distance value that initiates the boundary line determination steps described below in steps 928-952. In other words, the control module 20 essentially disregards sensors 31 that may negatively impact the accuracy of the boundary line determination algorithm. As an example, if sensor 31E, which is located on a trunk of the vehicle 30, obtains low RSSI measurements as a result of the remote device 10 being located near a front and opposite side of the vehicle 30, the control module 20 will disregard sensor 31E when executing the boundary line determination algorithm. If the RSSI of at least one of the half-hemisphere antennas 72 is greater than the threshold value, the control algorithm 900 proceeds to 928; otherwise, the control algorithm 900 proceeds to 940.

At 928, the control algorithm 900 determines, using the control module 20, whether the RSSI of a first half-hemisphere antenna 72-1 is significantly greater than the RSSI of the second half-hemisphere antenna 72-2. As an example, the RSSI of the first half-hemisphere antenna 72-1 may be significantly greater than the RSSI of the second half-hemisphere antenna 72-2 if it is greater by a predetermined threshold difference. If the RSSI of the first half-hemisphere antenna 72-1 is significantly greater than the RSSI of the second half-hemisphere antenna 72-2, the control algorithm 900 proceeds to 932; otherwise, the control algorithm 900 proceeds to 936. At 932, the control algorithm 900 determines, using the control module 20, that the remote device 10 is located on a corresponding side of the boundary line and proceeds to 940. At 936, the control algorithm 900 determines, using the control module 20, that the remote device 10 is located near the boundary line and proceeds to 940.

At 940, the control algorithm 900 determines, using the control module 20, whether there are additional sensors 31. If so, the control algorithm proceeds to 944; otherwise, the control algorithm 900 proceeds to 948. At 944, the control algorithm 900 selects, using the control module 20, the next sensor pair and proceeds to 924. At 948, the control algorithm 900 determines, using the control module 20, whether step 928 has previously been executed. If so, the control algorithm 900 proceeds to 952; otherwise, the control algorithm 900 proceeds to 916.

At 952, the control algorithm 900 determines, using the control module 20, a location of the remote device based on the at least one boundary line determination. Additionally, the control module 20 may determine a distance between the remote device 10 and the vehicle 30. At 956, the control algorithm 900 determines whether the location is associated with making a vehicle function available to the user. If so, the control algorithm 900 proceeds to 960; otherwise, the control algorithm 900 proceeds to 916. At 960, the control algorithm 900 makes the corresponding vehicle function available to the user (e.g., unlocking the door) and then ends at 964

In accordance with the present teachings, an apparatus includes a processor configured to execute instructions stored in a nontransitory computer readable medium. The instructions include: receiving, using the processor, information corresponding to a first signal strength of a communication link between a remote device and a communication gateway of a vehicle, wherein the information corresponding to the first signal strength is associated with a first antenna of a sensor, and wherein the first antenna includes a first peak main lobe magnitude oriented in a first direction; receiving, using the processor, information corresponding to a second signal strength of the communication link, wherein the information corresponding to the second signal strength is associated with a second antenna, and wherein the second antenna includes a second peak main lobe magnitude oriented in a second direction; and executing, using the processor, a first boundary line determination, wherein executing the first boundary line determination includes determining whether the remote device is located on a first side of a boundary line based on the first signal strength and the second signal strength.

In accordance with the present teachings, a midpoint of the boundary line is located at a first point, and wherein the first point is equidistant from the first antenna and the second antenna.

In accordance with the present teachings, the boundary line is perpendicular to the first direction and the second direction.

In accordance with the present teachings, the first antenna and second antenna are physically coupled using a coupling device.

In accordance with the present teachings, the coupling device is a window glass.

In accordance with the present teachings, the first antenna and second antenna are separated by an air gap.

In accordance with the present teachings, the instructions include: receiving, using the processor, information corresponding to a third signal strength of the communication link, wherein the information corresponding to the third signal strength is associated with a third antenna, and wherein the third antenna includes a third peak main lobe magnitude oriented in a third direction; receiving, using the processor, information corresponding to a fourth signal strength of the communication link, wherein the information corresponding to the fourth signal strength is associated with a fourth antenna, and wherein the fourth antenna includes a fourth peak main lobe magnitude oriented in a fourth direction; and executing, using the processor, a second boundary line determination, wherein executing the second boundary line determination includes determining whether the remote device is located on a first side of a second boundary line based on the third signal strength and the fourth signal strength.

In accordance with the present teachings, the instructions include determining, using the processor, a location of the remote device based on the first boundary line determination and the second boundary line determination.

In accordance with the present teachings, the instructions include activating a vehicle function in response to the location of the remote device being located within a threshold distance of the vehicle.

In accordance with the present teachings, the instructions include determining, using the processor, a location of the remote device based on the first boundary line determination.

In accordance with the present teachings, a method includes: receiving, using a processor configured to execute instructions stored in a nontransitory computer readable medium, information corresponding to a first signal strength of a communication link between a remote device and a communication gateway of a vehicle, wherein the information corresponding to the first signal strength is associated with a first antenna of a sensor, and wherein the first antenna includes a first peak main lobe magnitude oriented in a first direction; receiving, using the processor, information corresponding to a second signal strength of the communication link, wherein the information corresponding to the second signal strength is associated with a second antenna, and wherein the second antenna includes a second peak main lobe magnitude oriented in a second direction; and executing, using the processor, a first boundary line determination, wherein executing the first boundary line determination includes determining whether the remote device is located on a first side of a boundary line based on the first signal strength and the second signal strength.

In accordance with the present teachings, a midpoint of the boundary line is located at a first point, and wherein the first point is equidistant from the first antenna and the second antenna.

In accordance with the present teachings, the boundary line is perpendicular to the first direction and the second direction.

In accordance with the present teachings, the first antenna and second antenna are physically coupled using a coupling device.

In accordance with the present teachings, the coupling device is a window glass.

In accordance with the present teachings, the first antenna and second antenna are separated by an air gap.

In accordance with the present teachings, the method includes: receiving, using the processor, information corresponding to a third signal strength of the communication link, wherein the information corresponding to the third signal strength is associated with a third antenna, and wherein the third antenna includes a third peak main lobe magnitude oriented in a third direction; receiving, using the processor, information corresponding to a fourth signal strength of the communication link, wherein the information corresponding to the fourth signal strength is associated with a fourth antenna, and wherein the fourth antenna includes a fourth peak main lobe magnitude oriented in a fourth direction; and executing, using the processor, a second boundary line determination, wherein executing the second boundary line determination includes determining whether the remote device is located on a first side of a second boundary line based on the third signal strength and the fourth signal strength.

In accordance with the present teachings, the method includes determining, using the processor, a location of the remote device based on the first boundary line determination and the second boundary line determination.

In accordance with the present teachings, the method includes activating a vehicle function in response to the location of the remote device being located within a threshold distance of the vehicle.

In accordance with the present teachings, the method includes determining, using the processor, a location of the remote device based on the first boundary line determination.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. An apparatus comprising:

a processor configured to execute instructions stored in a nontransitory computer readable medium;

a sensor including a first directional antenna, a second directional antenna, and a communication chipset, the communication chipset being configured to communicate information about signals received by the first and second directional antennas to the processor, the first and second directional antennas each having a front lobe and a back lobe, the front lobe being associated with a first receive gain and extending from the associated directional antenna in a first direction, the back lobe being associated with a second receive gain and extending from the associated directional antenna in a second direction opposite to the first direction, the first receive gain being greater than the second receive gain, the first and second directional antennas being arranged in the sensor on opposite sides of a boundary line such that the front lobe of the first directional antenna is diametrically opposed to the front lobe of the second directional antenna, the first and second directional antennas being physically coupled to each other within the sensor by a coupling device comprised of a window glass material, and the boundary line intersecting a midpoint of the coupling device between the first and second directional antennas;

wherein the instructions include:

receiving from the communication chipset, using the processor, information indicating a first signal strength of a communication link between a remote device and a communication gateway of a vehicle, wherein the first signal strength is associated with a signal received by the first directional antenna of the sensor;

receiving from the communication chipset, using the processor, information indicating a second signal strength of the communication link, wherein the second signal strength is associated with a signal received by the second directional antenna of the sensor; and determining, using the processor, whether the remote device is located on a first side of the boundary line based on the first signal strength and the second signal strength.

2. The apparatus of claim 1, wherein the midpoint of the boundary line is equidistant from the first directional antenna and the second directional antenna.

3. The apparatus of claim 2, wherein the boundary line is perpendicular to the first direction and the second direction.

4. The apparatus of claim 1, wherein the instructions include:

receiving, using the processor, information indicating a third signal strength of the communication link, wherein the information indicating the third signal strength is associated with a third directional antenna;

receiving, using the processor, information indicating a fourth signal strength of the communication link, wherein the information indicating the fourth signal strength is associated with a fourth antenna; and determining, using the processor, whether the remote device is located on a first side of a second boundary line based on the third signal strength and the fourth signal strength.

5. The apparatus of claim 4, wherein the instructions include determining, using the processor, a location of the remote device based on whether the remote device is located on the first side of the boundary line and on whether the remote device is located on the first side of the second boundary line.

6. The apparatus of claim 5, wherein the instructions include activating a vehicle function in response to the location of the remote device being located within a threshold distance of the vehicle.

7. The apparatus of claim 1, wherein the instructions include determining, using the processor, a location of the remote device based on whether the remote device is located on the first side of the boundary line.

8. A method comprising:

receiving from a communication chipset, using a processor configured to execute instructions stored in a non-transitory computer readable medium, information indicating a first signal strength of a communication link between a remote device and a communication gateway of a vehicle, wherein the information indicating the first signal strength is associated with a first directional antenna of a sensor, the sensor also including a second directional antenna and the communication chipset, the communication chipset being configured to communicate information about signals received by the first and second directional antennas to the processor, the first and second directional antennas each having a front lobe and a back lobe, the front lobe being associated with a first receive gain and extending from the associated directional antenna in a first direction, the back lobe being associated with a second receive gain and extending from the associated directional antenna in a second direction opposite to the first direction, the first receive gain being greater than the second receive gain, the first and second directional antennas being arranged in the sensor on opposite sides of a boundary line such that the front lobe of the first directional antenna is diametrically opposed to the front lobe of the second directional antenna, the first and second directional antennas being physically coupled to each other within the sensor by a coupling device comprised of a window glass material, and the boundary line intersecting a midpoint of the coupling device between the first and second directional antennas;

receiving from the communication chipset, using the processor, information indicating a second signal strength of the communication link, wherein the second signal strength is associated with a signal received by the second directional antenna of the sensor; and determining, using the processor, whether the remote device is located on a first side of the boundary line based on the first signal strength and the second signal strength.

9. The method of claim 8, wherein the midpoint of the boundary line is equidistant from the first directional antenna and the second directional antenna.

10. The method of claim 9, wherein the boundary line is perpendicular to the first direction and the second direction.

11. The method of claim 8, further comprising:

receiving, using the processor, information indicating a third signal strength of the communication link, wherein the information indicating the third signal strength is associated with a third directional antenna;

receiving, using the processor, information indicating a fourth signal strength of the communication link, wherein the information indicating the fourth signal strength is associated with a fourth antenna; and determining, using the processor, whether the remote device is located on a first side of a second boundary line based on the third signal strength and the fourth signal strength.

12. The method of claim 11 further comprising determining, using the processor, a location of the remote device based on whether the remote device is located on the first side of the boundary line and on whether the remote device is located on the first side of the second boundary line.

13. The method of claim 12 further comprising activating a vehicle function in response to the location of the remote device being located within a threshold distance of the vehicle.

14. The method of claim 8 further comprising determining, using the processor, a location of the remote device based on whether the remote device is located on the first side of the boundary line.

* * * * *